US006334280B1

(12) United States Patent
Frappart et al.

(10) Patent No.: US 6,334,280 B1
(45) Date of Patent: Jan. 1, 2002

(54) SOUND ABSORBING CEMENTITIOUS TILE

(75) Inventors: Etienne Frappart, Paris (FR); David Townsend, Nottingham (GB); William John McMillan, Nottingham (GB); Utkarsha Joshi, Nottingham (GB); William Bell Devereux, Nottingham (GB)

(73) Assignee: BPB PLC, Slough (GB)

( * ) Notice: Subject to any disclaimer, the term of this patent is extended or adjusted under 35 U.S.C. 154(b) by 0 days.

(21) Appl. No.: 09/125,069

(22) PCT Filed: Feb. 10, 1997

(86) PCT No.: PCT/GB97/00400

§ 371 Date: Oct. 7, 1998

§ 102(e) Date: Oct. 7, 1998

(87) PCT Pub. No.: WO97/29254

PCT Pub. Date: Aug. 14, 1997

(30) Foreign Application Priority Data

| | | |
|---|---|---|
| Feb. 8, 1996 | (GB) | 9602586 |
| Jul. 4, 1996 | (GB) | 9614075 |
| Oct. 3, 1996 | (GB) | 9620593 |

(51) Int. Cl.[7] ..... E04B 1/82

(52) U.S. Cl. ..... 52/144; 52/309.17; 52/506.06; 181/292; 181/293

(58) Field of Search ..... 52/506.06, 309.08, 52/309.14, 309.17, 144, 145; 181/284, 286, 290, 292, 293; 427/264, 270, 271

(56) References Cited

U.S. PATENT DOCUMENTS

| | | | | |
|---|---|---|---|---|
| 2,323,564 | A | 7/1943 | Page | |
| 2,708,300 | A | 5/1955 | Buttress | |
| 2,791,289 | A | 5/1957 | Proudfoot et al. | |
| 832,511 | A | 4/1960 | Irvine | |
| 2,967,583 | A | 1/1961 | Jack | |
| 2,995,198 | A | 8/1961 | Green | |
| 3,202,025 | A | 8/1965 | Carlson et al. | |
| 3,246,063 | A | 4/1966 | Podgurski | |
| 3,461,754 | A | 8/1969 | Griffen | |
| 5,560,881 | A | * 10/1996 | Hillman et al. | 264/265 |

FOREIGN PATENT DOCUMENTS

| | | |
|---|---|---|
| EP | 0686963 A2 | 12/1995 |
| FR | 1122345 | 9/1956 |
| FR | 1564234 | 4/1969 |
| GB | 664729 | 1/1952 |
| GB | 832511 | 4/1960 |
| GB | 1192306 | 5/1970 |
| GB | 2203772 A | 10/1988 |
| WO | WO870016 | 1/1987 |

OTHER PUBLICATIONS

Abstract of Patent Specification No. 26,343/67, Open to Public Inspection Oct. 22, 1970.

* cited by examiner

*Primary Examiner*—Yvonne M. Horton
(74) *Attorney, Agent, or Firm*—Birch, Stewart, Kolasch & Birch, LLP

(57) ABSTRACT

A die assembly for providing a gypsum ceiling tile having improved acoustic absorption properties includes a punch plate having punches which form perforations through a plasterboard tile and indentors which form indentations in the tile. The punches and indentors are arranged in elongate strips to produce fissure-like perforations and indentations. A stripper plate having apertures corresponding to the punches and indentors and a die plate having apertures corresponding to the punches sandwich the tile, and the punch plate is applied to the tile.

20 Claims, 4 Drawing Sheets as
1.2
1.0
0.8
0.6
0.4
0.2
0.0
63
125
250
500
1000
2000
4000
8000
f/Hz as
1.2
1.0
0.8
0.6
0.4
0.2
0.0
63
125
250
500
1000
2000
4000
8000
f/Hz

SOUND ABSORBING CEMENTITIOUS TILE

This application is the national phase under 35 U.S.C. §371 of prior PCT International Application No., PCT/GB97/00400, which has an International filing date of Feb. 10, 1997, which designated the United States of America, the entire contents of which are hereby incorporated by reference.

BACKGROUND OF THE INVENTION

1. Field of the Invention

The present invention relates to a cementitious tile having good acoustic properties, to a method of making such a tile and to a die assembly for use in the method.

2. Description of the Relevant Art

Board made from gypsum plaster is generically termed plasterboard. Conventional paper faced plasterboard is used as a cladding for building interiors, either to give, or to provide a base for, the desired decorative finish.

Plasterboard has been successfully used in other applications, such as ceiling tiles, but has not generally been very successful in applications where good acoustic absorption properties are required. GB-A-2 203 772 discloses a plasterboard having relatively good acoustic absorption properties. The board is perforated by holes or slits which are covered on one face of the board by cloth bonded to the board. WO-A-87/00116 discloses a plasterboard for use as an acoustic tile perforated with regular slots. It has been desired to improve the acoustic absorption properties of plasterboard tiles; it has also been desired to achieve this in a tile of esthetically pleasing appearance.

SUMMARY OF THE INVENTION

According to the present invention, there is provided a sound absorbent tile comprising cementitious material having through perforations which extend through cementitious material, characterised in that at least some of the perforations are fissure-like perforations. Preferably some of the perforations are circular in section.

By "fissure-like" is meant generally elongate perforations having irregular edges, preferably with an aspect ratio (the ratio of the length of the fissure to its maximum width) of at most 4:1. An aspect ratio of at least 2:1 is preferred.

Preferably, the tile is lined, for example with a paper liner and the lined surface has an array of indentations which extend through the liner and terminate in the cementitious material. The liner of the plasterboard is ruptured, giving rise to a product of distinctive appearance. The liner is forced into the indentations during their formation giving rise to a level of contrast in between the two extremes produced by the machining operations described previously.

Preferably, the openings of the through perforations on the side of the board opposite the lined surface (if any) are covered. In an especially preferred embodiment, these openings are covered with a sound absorbent material, preferably in sheet form such as acoustic paper or felt.

Also according to the invention there is provided a method of manufacturing a sound absorbent tile of cementitious board comprising:

contacting a planar surface of a cementitious board with the profiled surface of a punch plate having punches thereon, the shapes of at least some of the punches being such as to form fissure-like perforations;

perforating the board with fissure-like perforations by applying pressure between the board and the die such that the punches pass through the board; and thereafter separating the punch plate from the board.

Preferably, the profiled surface of the punch plate includes indentors of similar shape to the punches, shorter than the punches, the method comprising embedding the punches and the indentors in the board so that the punches through the board and the indentors penetrate but do not pass through the board.

If the board is lined, it is preferred that the punch plate impinges on the lined surface.

In a preferred method, the planar surface of the board is painted after the board has been punched and indented. In this way, any liner forced into the indentations can be left unpainted, particularly if the paint is applied with a roller for example. Painting provides a way of varying the degree of contrast between the indentations and the rest of the board.

In an especially preferred method, the surface of the board is spiked using a roller having radially extending spikes. Spiking can be used to produce fine pinholes in the surface of the board which gives a particularly pleasing appearance in combination with the fissure-like perforations and indentations.

Also according to the invention there is provided a die assembly for use in perforating cementitious board, comprising a punch plate and punches arranged in an array on the surface of the punch plate, the punches each having a substantially elongate fissure-like profile, to form fissure-like perforations in a board. Preferably, the die assembly further comprises indentors of similar shape to the punches for penetrating a cementitious board, the inventors being arranged on the surface of the punch plate and extending a smaller distance from the said surface than do the punches. Particularly preferably, the punch plate also carries circular punches for producing circular perforations in the board in addition to the fissure-like perforations.

It is preferred that the punches extend beyond the indentors by an amount at least as great as the thickness of the cementitious board so that the punches will have passed through the board before the indentors impinge on the board, thus making the through perforations before the indentations. By making the perforations before the indentations, the size of the press required to put the die assembly into operation is kept to a minimum.

It is also preferred that the die assembly includes a stripper plate and a die plate between which a tile is sandwiched to be perforated. The stripper plate has holes therethrough to allow the punches and indentors, if any, to pass through the plate and into the tile, and the die plate has holes therethrough for the parage of the punches after they have perforated the tile.

The punches and indentors may be formed of groups of adjacent cylindrical punch pins or by single punches or indentors of the desired shape. The holes in the punch plate to receive the punch pins or the punches and indentors can be formed by a wire erosion technique. Alternatively, the punches and indentors may be of a ceramic material set into a binder on the surface of the punch plate.

Also according to the invention there is provided a suspended ceiling comprising the tiles of the invention. Such a ceiling can have non-uniform acoustic properties and a substantially uniform appearance by using a mixture of tiles according to the invention and tiles of similar appearance having no through perforations but only fissure-like indentations. Ceilings can thus be made having desired overall acoustic properties; for example a ceiling can be made which is particularly suitable for an auditorium where speech must be clearly audible throughout.

DESCRIPTION OF THE DRAWINGS

An embodiment of the invention will now be described in detail, by way of example, with reference to the accompanying drawings in which.

DETAILED DESCRIPTION OF THE INVENTION

Figure 1:
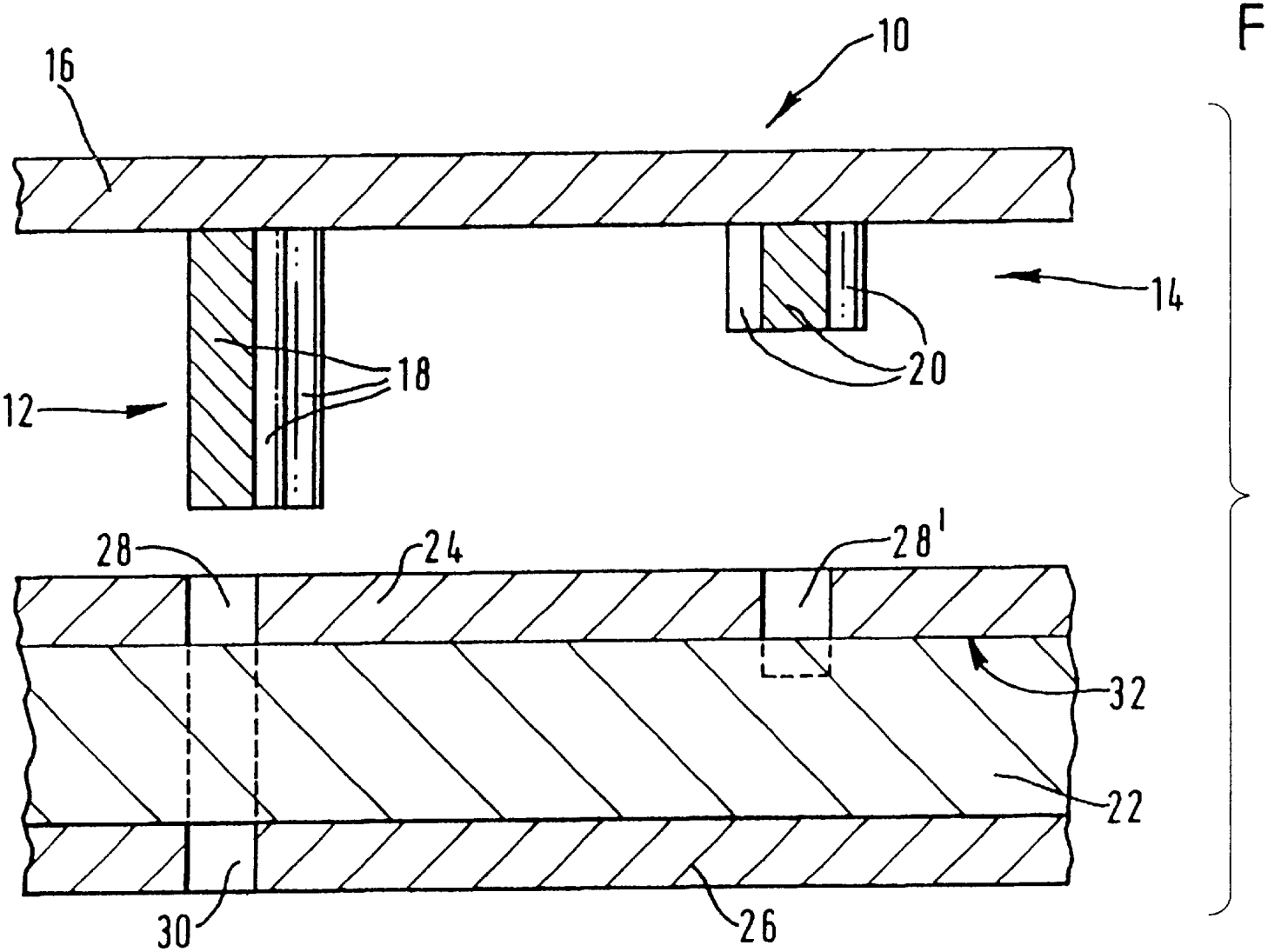
FIG. 1 is a schematic cross sectional view of a die assembly according to the invention in use to make a tile according to the invention.
Figure 2:
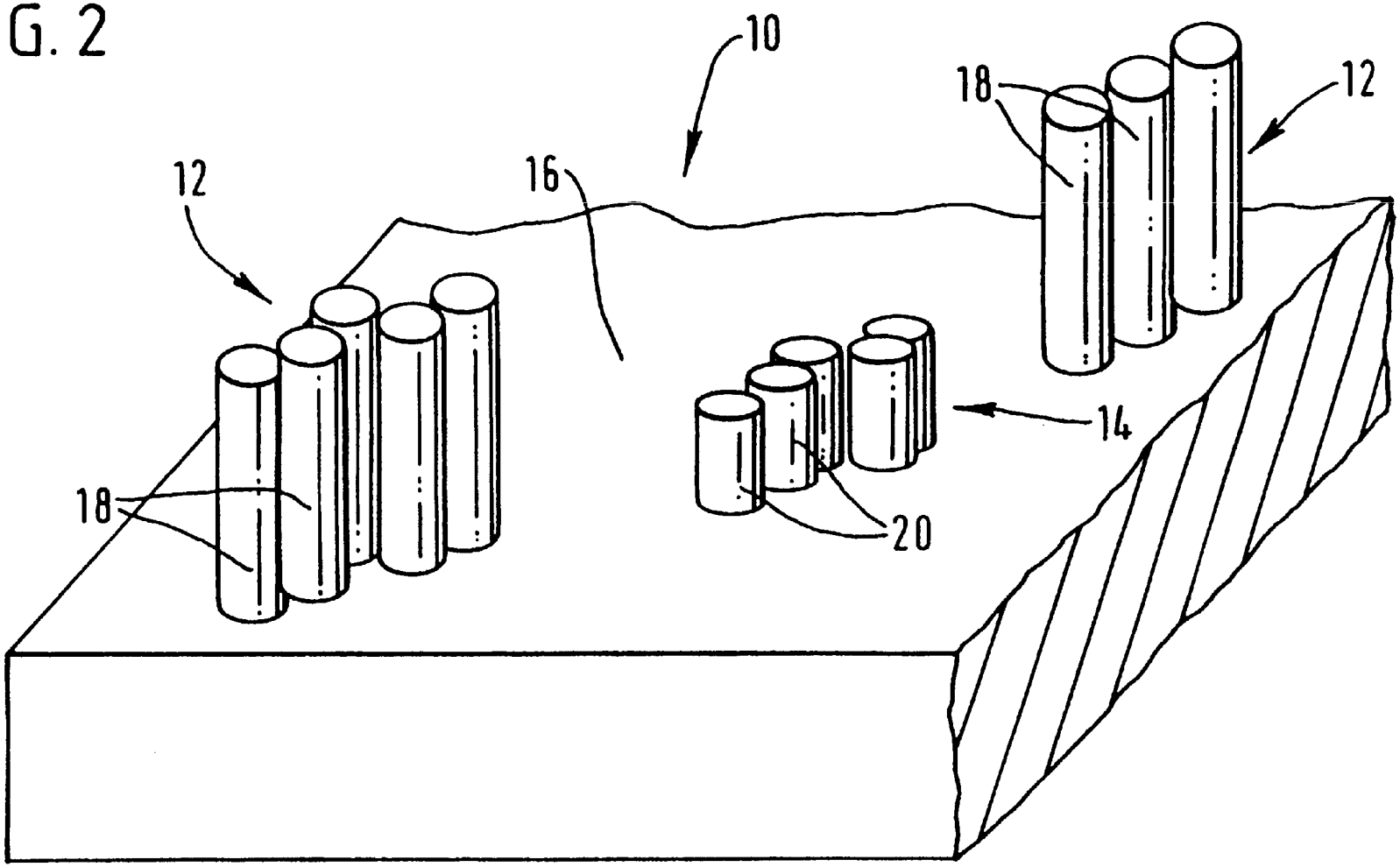
FIG. 2 shows a schematic perspective view of the punch plate of FIG. 1.

FIGS. 1 and 2 illustrate part of a die assembly 10 which includes long punches 12 and indentors 14 attached to a punch plate 16. The punches 12 consist of several punch pins 18 and the indentors 14 consist of several indentor pins 20; the pins 18,20 are rigidly attached to the punch plate 16, for example by welding or by having threaded lower portions which screw into threaded holes in the plate. The pins 18,20 are arranged in groups (see FIG. 2) to form punches 12 and indentors 14 which impart fissure-like perforations and indentations to a plasterboard tile 22 to which the die assembly 10 is applied. The punch pins 18 are cylindrical and are longer than the indentor pins 20. The punch plate preferably carries also single, circular punch pins (not shown) and may carry circular indentors (not shown).

The die assembly 10 also includes a top, stripper, plate 24 having apertures 28,28' corresponding to and large enough to accommodate the punches 12 and indentors 14, and a bottom, die, plate 26 having apertures 30 corresponding to the punches 12. In use, the die assembly 10 is mounted in a press and a lined plasterboard tile 22 is sandwiched between the rigidly mounted stripper 24 and die 26 plates. As the punch plate 16 is moved towards the tile 22, the punches and then the indentors exert a pressure of about 1.5 $MN/m^2$ on the tile 22. The punches 12 pass through the apertures 28 in the stripper plate 24 and press into the plasterboard. The punches 12 force plugs of plasterboard through the openings 30 in the die plate 26. In this way, the perforations are formed in the tile 22 before the indentors 14 engage the tile. As the punch plate 16 continues to advance towards the tile 22, the indentors 14 pass through the holes 28' in the stripper plate 24 and are embedded in the tile. Once the paper liner 32 of the tile 22 has been ruptured by the indentors 14, the operation is complete and the punch plate 16 is withdrawn.

The clearances between the punches 12 and the corresponding holes 30 in the die plate 26 should be chosen to ensure that the paper backing, if any, of the plasterboard tile 22 is cut cleanly away where the punches exit the plasterboard, while allowing the punches to be withdrawn from the die plate. If the top face of the tile is lined, for example with paper, the appearance of the top surface of the tile can be determined by the clearance between the punches 12 and indentors 14 and the holes 28 through the stripper plate 24. A very small clearance will give perforations and indentations having sharply defined edges while a greater clearance will give perforations and indentations with less well defined edges, where the fibres of the liner material are visible at those edges.

The punch 18 and indentor 20 pins are short lengths of metal rod welded to the metal punch plate 16, with the longitudinal axis of each approximately perpendicular to the plate. By arranging the pins 18,20 into elongate strings, a die assembly for producing fissure-like indentations in plasterboard is created. The pins forming the punches and indentors need not touch each other; small gaps between them can be desirable since they add to the irregularity of the edges of the fissure-like perforations and indentations made by the punches and indentors.

After being punched and indented, the fissure (or fissure and circular hole) pattern on the tile can be supplemented by a pinhole pattern imposed by spiking the surface of the plasterboard using a roller having spikes mounted radially on its periphery. The spikes in contact with the tile at any given time have a much smaller cross sectional area than the punches 12 and indentors 14 so the force on the roller required to drive the spikes into the plasterboard is significantly less than the force required on the punch plate 16 to produce the fissure indentations.

Figure 3:
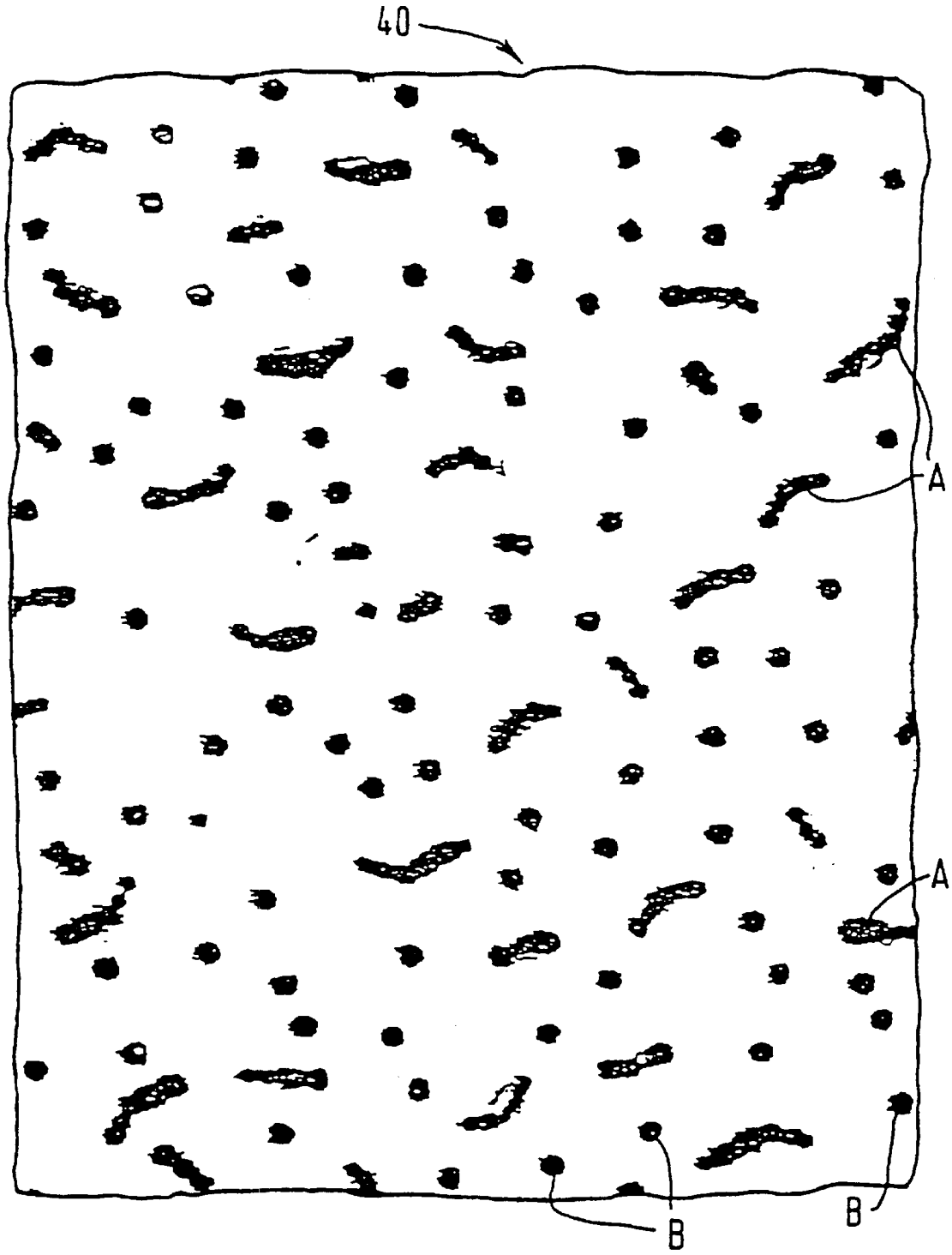
FIG. 3 shows part of a tile according to the invention.

A tile 40 produced by use of the die assembly 10 is shown in FIG. 3. The tile has fissure-like indentations A and circular perforations B. Preferably the ratio of fissure-like to circular perforations is preferably within the range 2:1 to 1:2. It has been found that satisfactory acoustic properties are achieved, without significant loss of strength, when about 6% of the total area of the principal faces of the tile has perforations. An aesthetically pleasing effect is achieved when additionally about 6% of the total area of the front face of the tile has indentations which do not pass through the tile.

FIG. 4 shows the result of acoustic tests conducted according to BS EN 20354:1993 on a control plasterboard tile and a plasterboard tile according to the invention. Both tiles are 9.5 mm thick, are lined on the back with 0.5 mm thick acoustic paper, have a surface density of 7 $kg/m^2$ and have perforations over 6% of their principal surfaces. The perforations in the control tile are 4mm diameter holes at 15 mm centres; those in the tile according to the invention are fissure-like perforations.

Figure 4A:
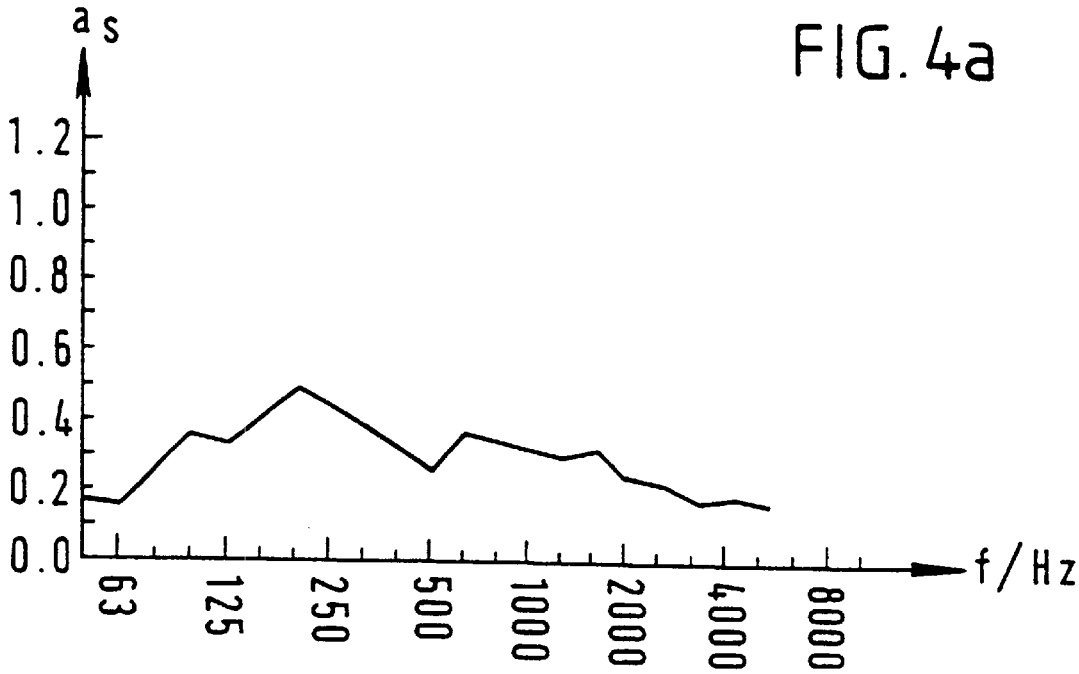
FIG. 4 shows graphically the results of acoustic tests in a tile according to the invention and a control.
Figure 4B:
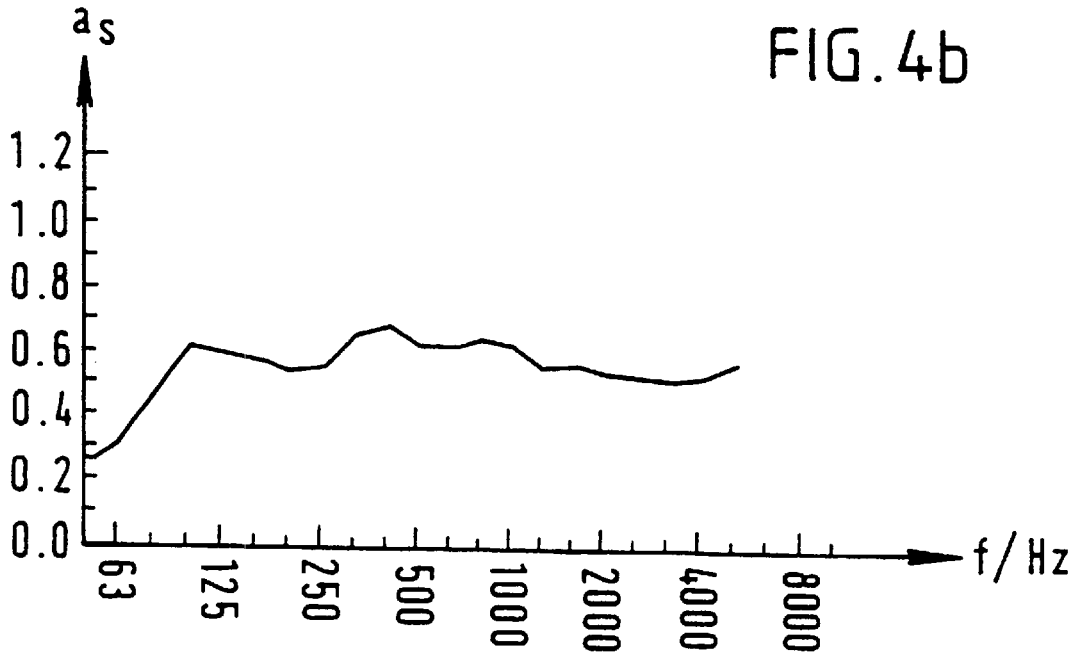

FIG. 4*a* shows a plot of the frequency of against the absorption coefficient as for the control tile, and FIG. 4*b* shows the same plot for the tile according to the invention.

It will be seen from FIG. 4 that the acoustic absorption performance of the tile according to the invention is significantly superior to that of the control tile over the entire frequency range tested, and that the tile according to the invention exhibits a generally flat acoustic profile, making it well suited to many different acoustic environments.

By varying the proportion of the surface area of the tile taken up by perforations, the acoustic properties of the tiles can be varied. The appearance of the tiles can be kept constant by providing indentations instead of perforations; the indentations have no significant effect on the acoustic properties of the tile.

One use of tiles according to the invention is in the constructions of suspended ceilings. It may be desired to provide an acoustically absorbent suspended ceiling having different acoustic properties in different parts. Tiles of similar appearance to those of the invention can be manufactured having no perforations but only fissure-like indentations; such tiles can be used with tiles according to the invention having to provide a suspended ceiling of uniform appearance but with acoustic properties which vary over the ceiling.

What is claimed is:

1. A sound absorbent tile comprising:

a cementitious material; and a plurality of through perforations opening on opposing side surfaces of said cementitious material, wherein at least one of said through perforations is an elongate fissure-shaped perforation, having irregular edges and being of constant cross section as said fissure-shaped perforation passes through said cementitious material.

2. The tile according to claim 1, wherein said cementitious material is gypsum plaster.

3. The tile according to claim 1, wherein some of said through perforations are generally cylindrical-shaped perforations.

4. The tile according to claim 1, further comprising:

a liner covering portions of said cementitious material.

5. The tile according to claim 4, wherein said liner is formed of paper.

6. The tile according to claim 1, wherein said at least one of said through perforations includes a plurality of elongate fissure-shaped perforations, and wherein said plurality of fissure-shaped perforations extend in substantially a same direction.

7. The tile according to claim 1, further comprising:

a covering disposed over an opening of some of said plurality of through perforations.

8. The tile according to claim 7, wherein said covering is formed of a sound absorptive material.

9. The tile according to claim 1, wherein a sum of cross sections of said plurality of through perforations is approximately 6% of a total cross section of a side surface of said cementitious material.

10. The tile according to claim 1, further comprising:

a liner covering one side surface of said cementitious material; and a plurality of indentations extending through said liner and terminating in said cementitious material.

11. The tile according to claim 10, wherein said plurality of indentations are fissure-shaped.

12. A sound absorbent tile comprising:

a generally planar member having a generally flat first surface and a generally flat second surface, opposite said first surface; and a plurality of first through perforations passing from respective first openings on said first surface to respective second openings on said second surface, wherein each first through perforation of said plurality of first through perforations has a fissure-shaped cross section which continues in a substantially uniform manner as said first through perforation passes through said generally planar member from said first opening to said second opening.

13. The tile according to claim 12, wherein said fissure-shaped cross sections of said plurality of first through perforations extend substantially in a common direction.

14. The tile according to claim 13, further comprising:

a plurality of second through perforations passing from respective third openings on said first surface to respective fourth openings on said second surface, wherein each second through perforation of said plurality of second through perforations has a circular-shaped cross section which continues in a substantially uniform manner as said second through perforation passes through said generally planar member from said third opening to said fourth opening.

15. The tile according to claim 14, wherein a sum of cross sections of said first openings and said third openings is approximately 6% of a total cross section of said first surface.

16. The tile according to claim 15, wherein said generally planar member is formed of a cementitious material.

17. A suspended ceiling comprising:

a plurality of suspended tiles including a plurality of first tiles, each of which includes:

a cementitious material; and a plurality of through perforations opening on opposing side surfaces of said cementitious material, wherein at least one of said through perforations is an elongate fissure-shaped perforation, having irregular edges and being of constant cross section as said fissure-shaped perforation passes through said cementitious material.

18. The suspended ceiling according to claim 17, wherein said plurality of suspended tiles exhibits substantially uniform acoustic properties and substantially uniform appearance.

19. The suspended ceiling according to claim 17, wherein said plurality of suspended tiles further includes a plurality of second tiles, each of which includes:

a cementitious material; and a plurality of indentations in said cementitious material, wherein at least one of said indentations is an elongate fissure-shaped indentation.

20. The suspended ceiling according to claim 19, wherein said plurality of suspended tiles exhibits non-uniform acoustic properties and substantially uniform appearance.

* * * * *